US009756928B2

(12) United States Patent
Cameron et al.

(10) Patent No.: US 9,756,928 B2
(45) Date of Patent: Sep. 12, 2017

(54) ARMBAND FOR HOLDING AN ELECTRONIC DEVICE

(71) Applicant: Apple Inc., Cupertino, CA (US)

(72) Inventors: Gordon Cameron, Sunnyvale, CA (US); Cameron Frazier, Chicago, IL (US)

(73) Assignee: Apple Inc., Cupertino, CA (US)

( * ) Notice: Subject to any disclaimer, the term of this patent is extended or adjusted under 35 U.S.C. 154(b) by 288 days.

(21) Appl. No.: 14/499,015

(22) Filed: Sep. 26, 2014

(65) Prior Publication Data

US 2015/0060506 A1 Mar. 5, 2015

Related U.S. Application Data

(63) Continuation of application No. 12/186,319, filed on Aug. 5, 2008, now Pat. No. 8,857,683.

(51) Int. Cl.
*A45F 5/00* (2006.01)
*A45C 11/00* (2006.01)

(52) U.S. Cl.
CPC ..... *A45F 5/00* (2013.01); *A45C 11/00* (2013.01); *A45C 2011/001* (2013.01); *A45F 2005/008* (2013.01); *A45F 2200/0516* (2013.01); *Y10S 224/93* (2013.01)

(58) Field of Classification Search
CPC ..... A45F 5/00; A45F 2005/008; A45F 2200/0516; A45C 11/00; A45C 2011/001; Y10S 224/93
See application file for complete search history.

(56) References Cited

U.S. PATENT DOCUMENTS

| | | | | |
|---|---|---|---|---|
| 5,244,134 | A * | 9/1993 | Riley | A44C 5/0053 224/152 |
| 5,511,702 | A | 4/1996 | Yang | |
| 6,085,449 | A | 7/2000 | Tsui | |
| 6,240,568 | B1 | 6/2001 | Lee | |
| D526,780 | S | 8/2006 | Richardson et al. | |
| D542,524 | S | 5/2007 | Richardson et al. | |
| 2002/0101457 | A1* | 8/2002 | Lang | G06F 1/163 715/856 |
| 2005/0098616 | A1 | 5/2005 | Chang | |
| 2007/0215663 | A1* | 9/2007 | Chongson | A45C 1/04 224/650 |
| 2008/0017678 | A1 | 1/2008 | Anderson et al. | |
| 2008/0257706 | A1 | 10/2008 | Haag | |
| 2009/0057357 | A1 | 3/2009 | Rohrbach et al. | |

* cited by examiner

*Primary Examiner* — Corey Skurdal
(74) *Attorney, Agent, or Firm* — Downey Brand LLP

(57) ABSTRACT

An armband that holds an electronic device is presented. The armband includes a pouch which includes a window and an opening configured to allow an electronic device to be inserted into the pouch. The armband also includes an arm strap wherein the proximate end of the arm strap is coupled to the pouch, and wherein the arm strap includes: holes arranged in a specified pattern; loop cells at specified locations along the length of the arm strap; and a hook cell located at a distal end of the arm strap. The armband further includes a ring coupled to the pouch configured to allow the distal end of the arm strap to be passed through the ring and pulled toward the proximate end of the arm strap so that the hook cell can be coupled to one or more loop cells.

17 Claims, 8 Drawing Sheets

ARMBAND FOR HOLDING AN ELECTRONIC DEVICE

CROSS-REFERENCE TO RELATED APPLICATIONS

This application is a continuation of U.S. application Ser. No. 12/186,319 filed Aug. 5, 2008, entitled "ARMBAND FOR HOLDING AN ELECTRONIC DEVICE," the contents of which are incorporated herein by reference in their entirety for all purposes.

FIELD

The present invention relates to an armband which is configured to hold an electronic device.

BACKGROUND

Electronic devices such as portable music players, cell phones, and personal digital assistants (PDAs) are used every day by millions of people. Though electronic devices are becoming smaller, carrying these electronic devices may still present a problem. For example, PDAs and hybrid PDA-cell phone devices are typically large and cumbersome to place in a pocket. Similarly, carrying and using a portable music player while exercising can be a challenge.

Existing techniques for carrying these electronic devices may include using an armband. For example, a pouch for receiving an electronic device may be coupled to a strip of material to form an armband that a user may use to hold the pouch on the user's arm or body. The pouch may be of any suitable size, for example sized to receive a particular electronic device. The pouch may include a window through which an electronic device screen and an electronic device input mechanism may be viewed and manipulated by a user.

If the electronic device has a curved outer surface, for example an outer surface associated with an elliptical cross-section or an ellipsoid shape, the window may bow upwards due to contacts between the window and portions of the outer surface. If the window is stiff, for example for aesthetic or tactile reasons, the window bowing may be more pronounced. This may cause gaps to develop between the electronic device screen or input mechanism and the window, which may in turn adversely affect a user's experience. For example, the gap between the window and the screen may distort the user's perception of the displayed content. As another example, the gap between the window and the input mechanism may prevent the user from providing inputs to the device or detecting feedback that particular inputs were provided (e.g., the user cannot feel a click when a button is pressed and, for example a dome switch is inverted).

SUMMARY

An armband having a pouch operative to receive an electronic device having a curved surface is provided.

The pouch may include several apertures through which an electronic device screen and an electronic device input mechanism may be visible. The apertures may be covered by a window bonded to a surface of the pouch (e.g., an interior surface of a front face of the pouch). Each of the apertures may have different sizes, for example such that the aperture associated with the screen is larger than the aperture associated with the input mechanism.

To ensure that the window does not bow up above the input mechanism by an amount that would adversely affect the device operation, the width of the window may vary. For example, the window may be wider in areas adjacent to the aperture for the screen, and narrower in areas adjacent to the input mechanism. This may allow the contact point at which the window becomes tangential to the electronic device surface to be closer to the center of the electronic device in areas adjacent to the input mechanism. This in turn may reduce the amount by which the window is offset from the surface of the input mechanism and ensure that the quality of the user experience is maintained.

In some embodiments, the portion of the window adjacent to the opening of the pouch through which the electronic device is inserted may include a curved edge relative the side from which the electronic device is inserted into the pouch. For example, the window may include an edge in the shape of a half circle such that upon inserting the device in the pouch, only a single point on the edge will initially come into contact with the electronic device (e.g., in contrast to the window having a straight line parallel to the side of the pouch from which the electronic device is inserted).

BRIEF DESCRIPTION OF THE DRAWINGS

The various embodiments of the invention are set forth in the following detailed description, taken in conjunction with the accompanying drawings, in which like reference characters refer to like parts throughout, and in which.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

Figure 1A:
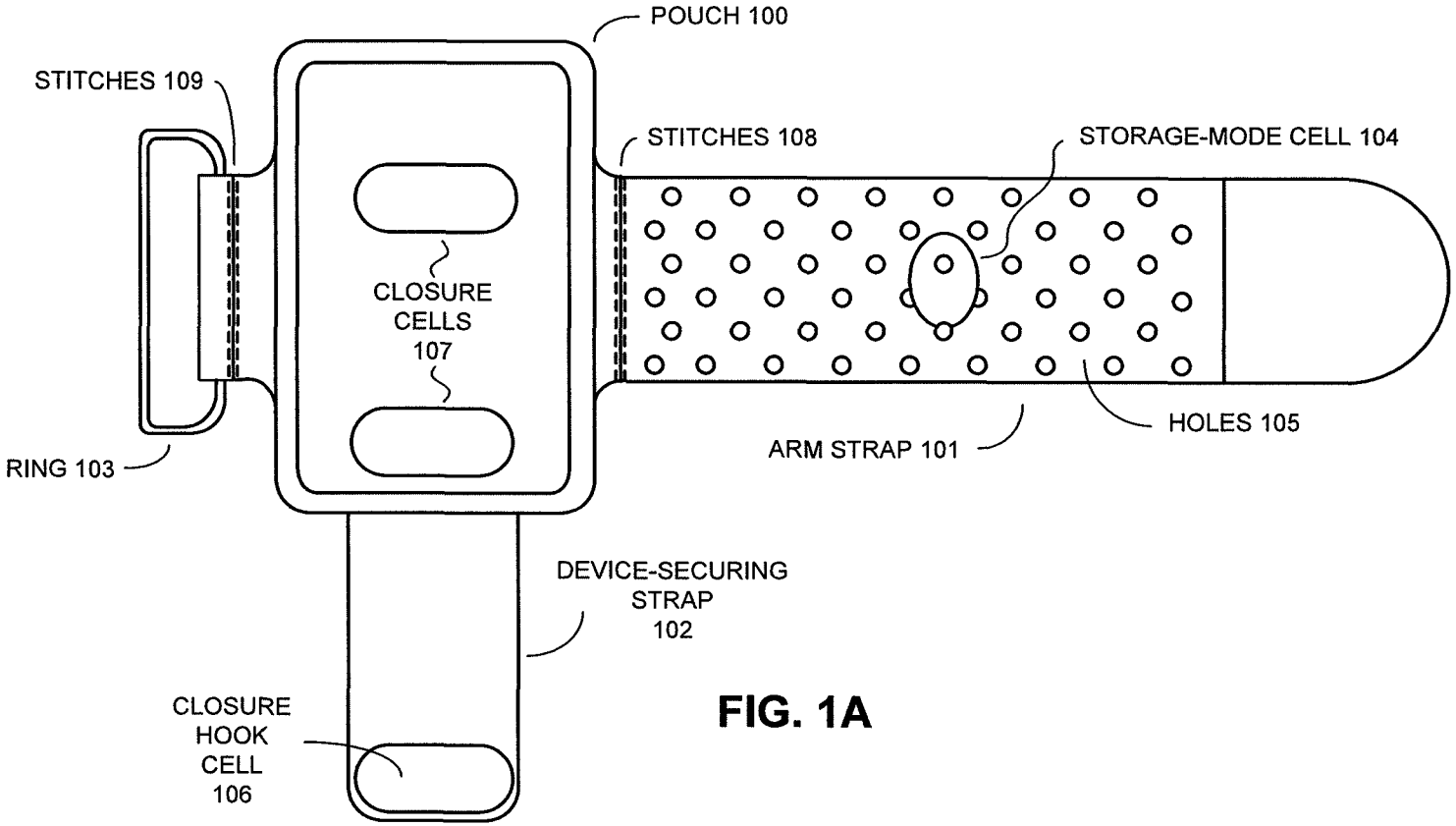
FIG. 1A presents a back view of an armband in accordance with an embodiment of the present invention.
Figure 1B:
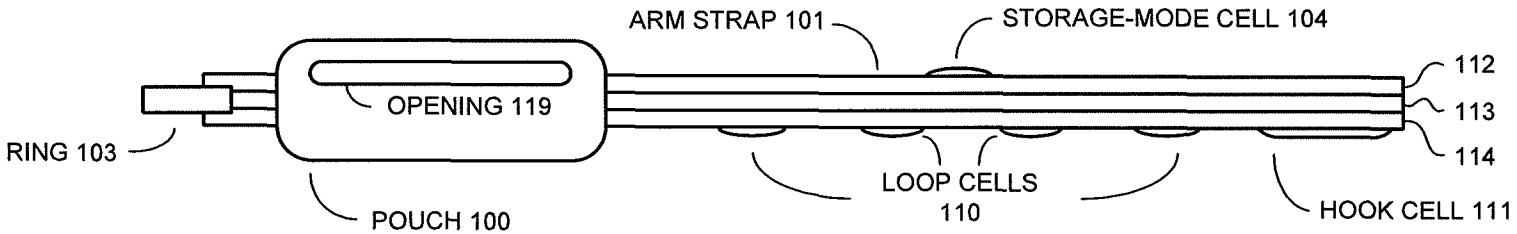
FIG. 1B presents a cross-sectional view of an armband in accordance with an embodiment of the present invention.
Figure 1C:
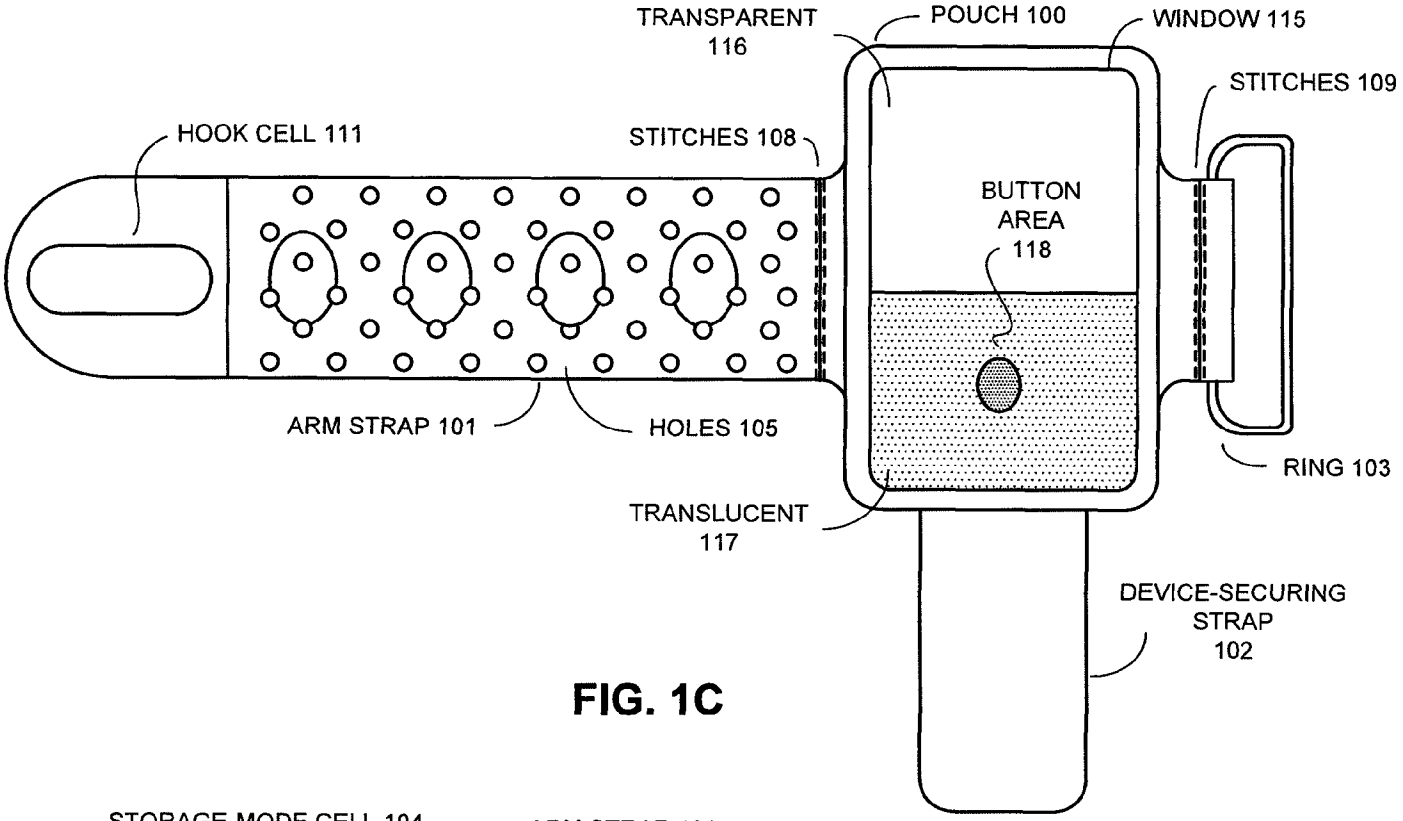
FIG. 1C presents a front view of an armband in accordance with an embodiment of the present invention.
Figure 1D:
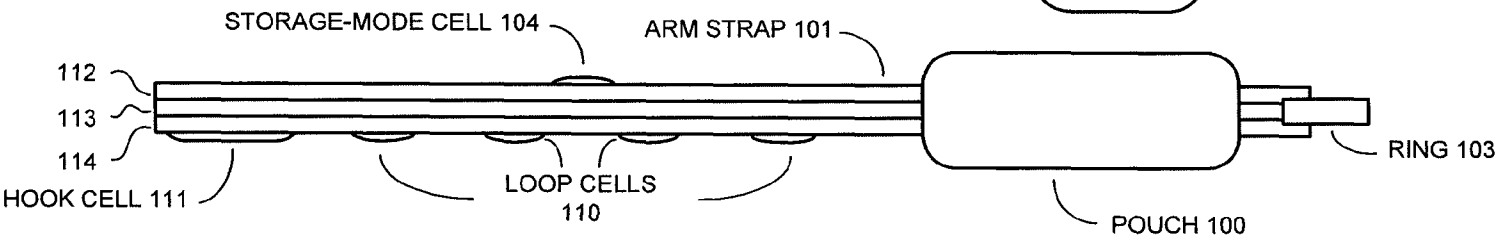
FIG. 1D presents another cross-sectional view of an armband in accordance with an embodiment of the present invention.

FIGS. 1A-1D present a number of views of an armband in accordance with an embodiment of the present invention. More specifically, FIG. 1A presents a back view of an armband in accordance with an embodiment of the present invention; FIG. 1B presents a cross-sectional view of an armband in accordance with an embodiment of the present invention; FIG. 1C presents a front view of an armband in accordance with an embodiment of the present invention; and FIG. 1D presents another cross-sectional view of an armband in accordance with an embodiment of the present invention.

The armband illustrated in FIGS. 1A-1D includes pouch 100. In some embodiments, pouch 100 includes opening 119 along one edge of pouch 100 which can be used to insert an electronic device into pouch 100. The electronic device can include, but is not limited to: a music player; a mobile phone; and any other mobile electronic device. In some embodiments, the inner lining of pouch 100 is made from a polyurethane microfiber material.

Figure 3B:
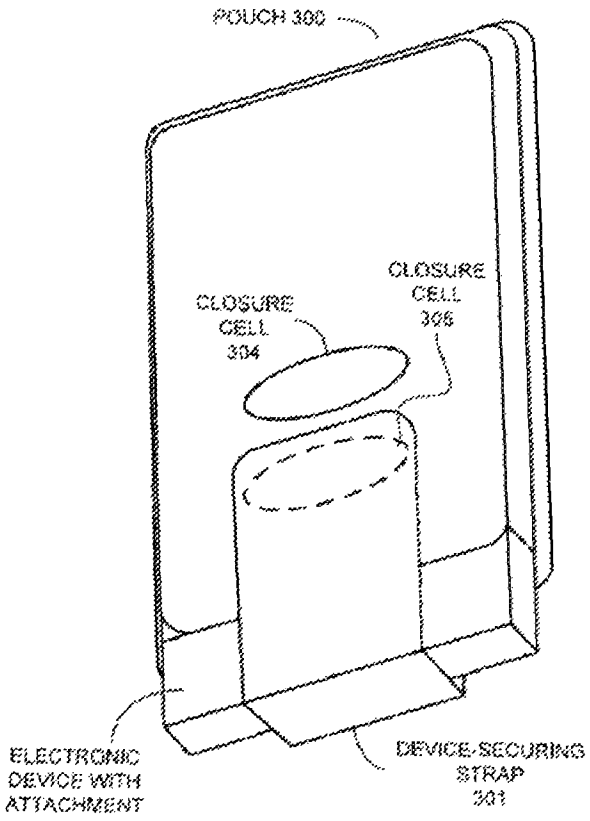
FIG. 3B presents back view of a pouch for an armband which is holding a larger electronic device with an attachment in accordance with an embodiment of the present invention.
Figure 3A:
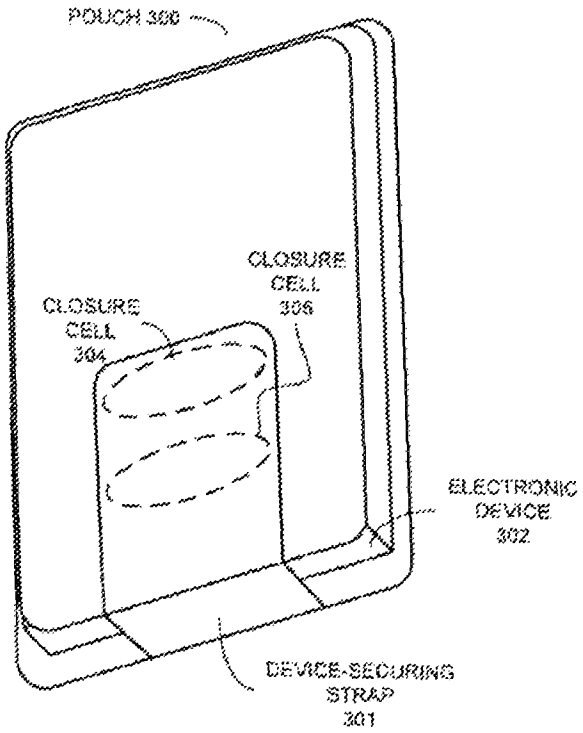
FIG. 3A presents back view of a pouch for an armband which is holding an electronic device in accordance with an embodiment of the present invention.

In some embodiments, pouch 100 is coupled to device-securing strap 102, which includes closure hook cell 106. Furthermore, one or more closure cells 107 are coupled to a back face of pouch 100. Note that although FIG. 1A illustrates two closure cells, any number of closure cells can be used depending on the application. Furthermore, the configuration of the closure cells can be adjusted according to a specified application (e.g., to accommodate electronic devices of varying sizes or a device that may or may not have an attached dongle). Closure hook cell 106 is configured so that device-securing strap 102 can be folded over the opening of the pouch and closure hook cell 106 can be coupled to one or more closure cells 107. The operation of device-securing strap 102 is illustrated in FIGS. 3A and 3B.

Arm strap 101 is coupled to pouch 100. In some embodiments, arm strap 101 is coupled to pouch 100 using stitches 108. Stitches 108 provide mechanical coupling strength between arm strap 101 and pouch 100.

In some embodiments, arm strap 101 includes one or more of: a plurality of holes 105, storage-mode cell 104, loop cells 110, and hook cell 111. Note that the number of loop cells is not limited to four loop cells and can generally be any number of loop cells depending on the application. In some embodiments, the plurality of holes 105 is punched through arm strap 101. The plurality of holes 105 can be configured in a specified pattern to achieve a desired property of arm strap 101. For example, the specified pattern can be chosen to balance between stretchability and breathability of arm strap 101. In some embodiments, the diameters of the holes are substantially the same. In some embodiments, diameter of the holes is between 1.5 millimeters and 3.5 millimeters inclusive.

Note that the various cells used in the present invention can be Velcro® cells or any other type of fasteners. For example, loop cells 110, storage-mode cell 104 and closure cells 107 can be fuzzy Velcro® cells, and hook cell 111 and closure hook cell 106 can be hook Velcro cells.

In some embodiments, the specified pattern for the plurality of holes includes one or more of rows of holes wherein holes in a given row are offset a specified distance from a centerline of holes in an adjacent row. In some embodiments, the specified distance is one-half the distance between a pair of holes in the adjacent row of holes. Adjacent holes can be equally spaced from each other or spaced so that the distance between adjacent holes follows a specified pattern. In some embodiments, adjacent holes within a row are spaced 6.7 millimeters as measured from a centerline of the adjacent holes.

In some embodiments, adjacent rows of holes are substantially equally spaced. In some embodiments, adjacent rows of holes are spaced between 3.8 millimeters and 4 millimeters inclusive as measured from the centerlines of adjacent rows of holes.

Figure 6:
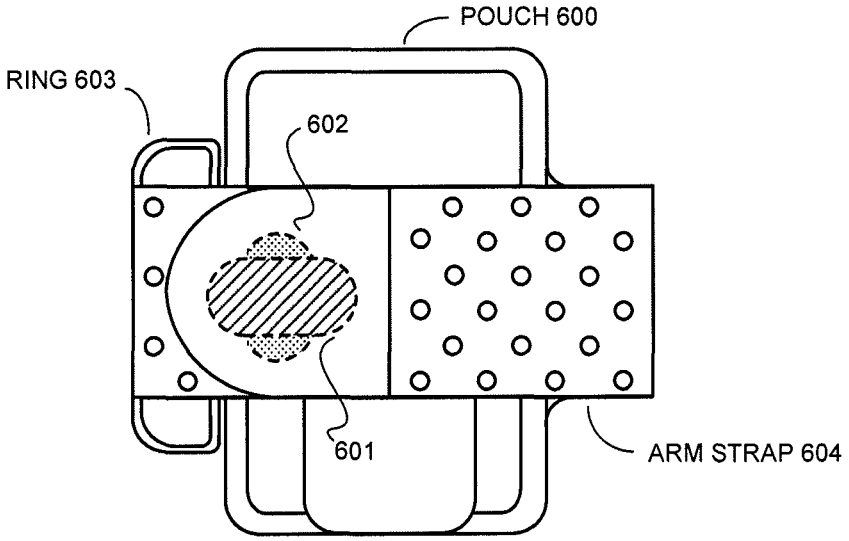
FIG. 6 presents a view of the armband when the arm strap is wrapped around the pouch so that a hook cell on the arm strap is coupled to a storage-mode cell on the arm strap in accordance with an embodiment of the present invention.

In some embodiments, storage-mode cell 104 is configured so that when the arm strap is wrapped around the pouch, hook cell 111 can be coupled to the storage-mode cell. These embodiments allow the arm strap to be secured so that hook cell 111 does not inadvertently attach to other materials (e.g., clothing) while the armband is placed in storage (e.g., in a drawer, in a gym bag, etc.). The operation of storage-mode cell 104 is illustrated in FIG. 6.

Figure 4A:
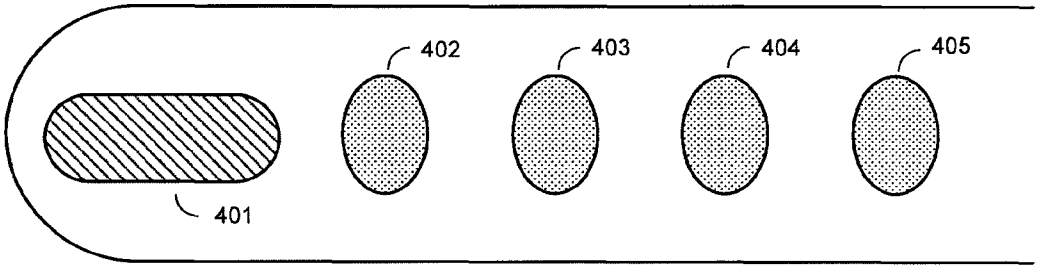
FIG. 4A presents a view of an arm strap for the armband in accordance with an embodiment of the present invention.
Figure 4B:
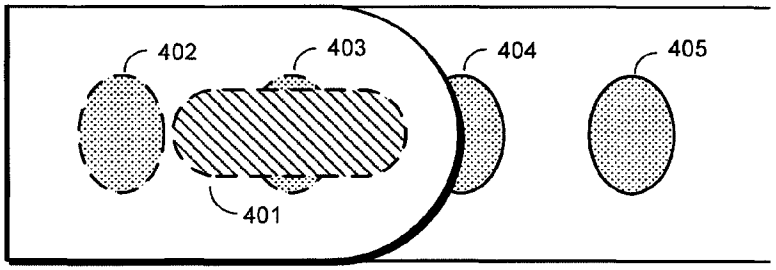
FIG. 4B presents a view of an arm strap for the armband wherein a hook cell is coupled to a loop cell in accordance with an embodiment of the present invention.
Figure 4C:
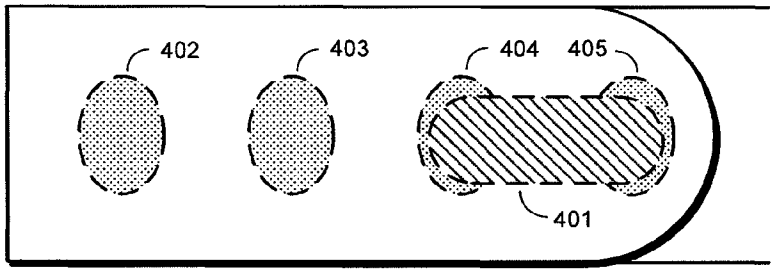
FIG. 4C presents a view of an arm strap for the armband wherein a hook cell is coupled to two loop cells in accordance with an embodiment of the present invention.

In some embodiments, loop cells 110 are located on the arm strap so that hook cell 111 can overlap at least two adjacent loop cells. Note that in these embodiments, hook cell 111 may be able to overlap a single loop cell, but is more likely to overlap two adjacent loop cells. The operation of loop cells 110 and hook cell 111 is illustrated in FIGS. 4A-4C. Also note that the shapes of closure cells 107, closure hook cell 106, loop cells 110, and hook cell 111 are illustrated as ovals. However, these cells can be any shape depending on the application. For example, oval loop cells (and oval storage-mode cell) oriented so that the longer dimension of the oval is substantially aligned with the shorter dimension of arm strap 101 (as illustrated in FIGS. 1A and 1C) allow for more stretch in the lateral direction as compared to circular cells or oval cells oriented in a different direction.

Figure 5A:
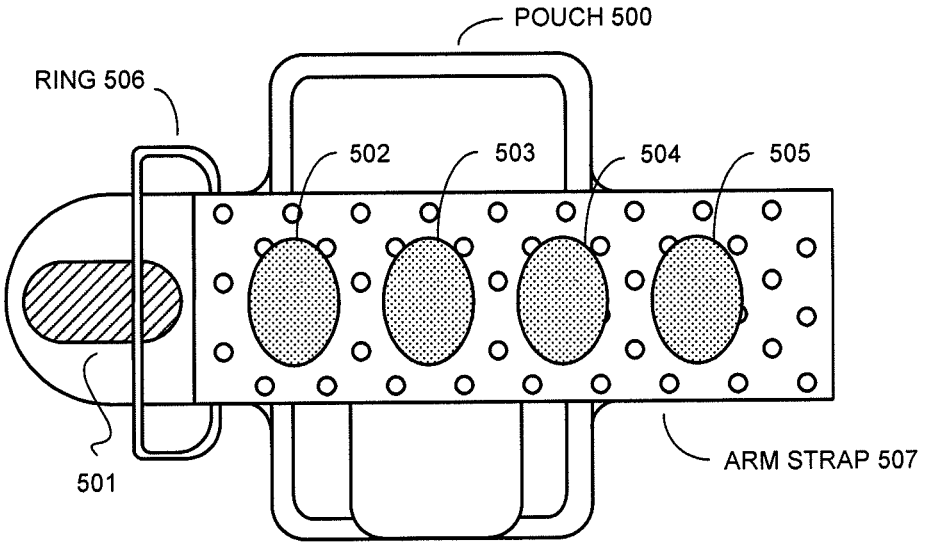
FIG. 5A presents a view of an arm strap inserted into a ring in accordance with an embodiment of the present invention.
Figure 5B:
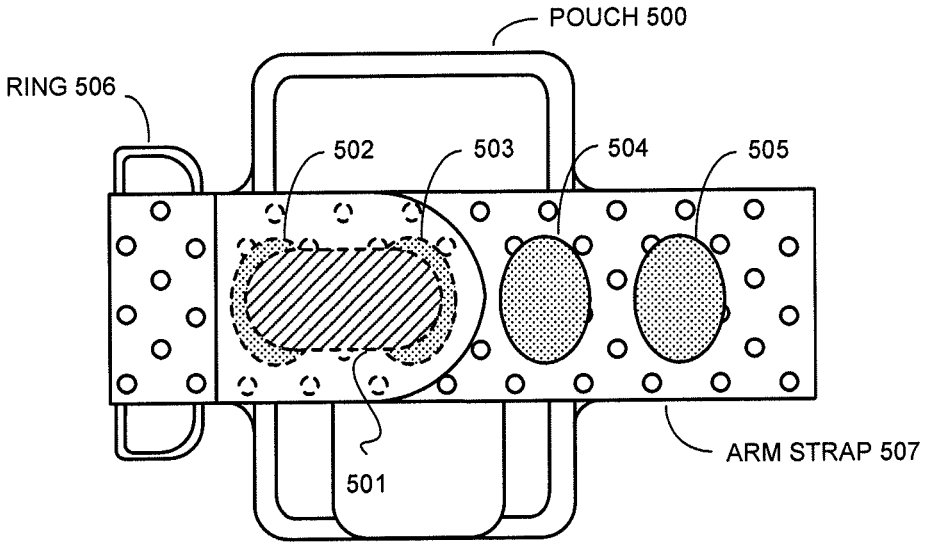
FIG. 5B presents a view of a hook cell on an arm strap secured to a loop cell on the arm strap in accordance with an embodiment of the present invention.

In some embodiments, ring 103 is coupled to pouch 100. In some embodiments, ring 103 is coupled to pouch 100 using stitches 109. Stitches 109 provide mechanical coupling strength between ring 103 and pouch 100. Ring 103 is configured to allow arm strap 101 to be passed through ring 103 and pulled back across arm strap 101 so that hook cell 111 can be coupled to one or more loop cells 110, thereby securing the armband to an arm. The operation of ring 103 is illustrated in FIGS. 5A-5B.

In some embodiments, pouch 100 includes window 115. Window 115, which can be constructed from any suitable material, including for example plastic, can be bonded to the pouch using an adhesive, heat, and pressure. In some embodiments, window 115 includes a substantially transparent portion 116 and a substantially translucent portion 117. In some embodiments, substantially translucent portion 117 is formed by applying an ink to a portion of an outer surface of the window. The ink can be formulated so that that the ink provides one or more of: a frosty and translucent appearance; and a low-friction scrolling surface for a finger. Note that other processes can be used to create translucent portion 117.

In some embodiments, window 115 includes button area 118, which is configured to facilitate locating a button on the electronic device within the pouch. Furthermore, button area 118 can protrude out-of-plane from the outer surface of the window to facilitate locating button area 118. Note that all of button area 118 or a portion of button area 118 can protrude out-of-plane from the outer surface of the window. Alternatively, button area 118 can be co-planar with the outer surface of the window. Button area 118 can be formed using a hydroforming process which presses the window into a desired shape. Note that other shape-forming processes can be used. In some embodiments, button area 118 is formed after ink is applied to window 115. In some embodiments, button area 118 is within translucent portion 117.

In some embodiments, arm strap 101 can include three layers 112-114. In some embodiments, layers 112 and 114 are made of polyurethane and layer 113 is made of spandex. The polyurethane-spandex polyurethane layer provides several advantages including, but not limited to: allowing arm strap 101 to stretch but not so far that it will break; not drying out and becoming brittle over time; allowing arm strap 101 to be made thinner than alternatives (e.g., neoprene); the coefficient of thermal expansion is comparable to the other material used in the armband; and the layer is edge stable (e.g., resistant to fraying) so that after die cutting the shape of arm strap 101, the edges of arm strap 101 do not need to be refinished (e.g., sewn, etc.).

In some embodiments, the arm strap and the front face of pouch 100 are made from a single piece of polyurethane-spandex-polyurethane material. In these embodiments, the front face of pouch 100 is bonded to the back face of pouch 100 along the edges of the pouch. In some embodiments, the bond is created using adhesive, heat, and pressure applied at the edges of the pouch. Note by using this bonding process, stitches are not required to couple the front face of pouch 100 with the back face of pouch 100. In one embodiment, the adhesive is a urethane-based adhesive. After the front face and the back face of pouch 100 are bonded together, a hole is cut into the back face of pouch 100 to create the opening in the pouch. In some embodiments, a reflective material be coupled to the surface of pouch 100, arm strap 101, or any other suitable portion of the armband for ensuring that a user of the armband may be visible in low-light environments (e.g., at night).

Figure 2A:
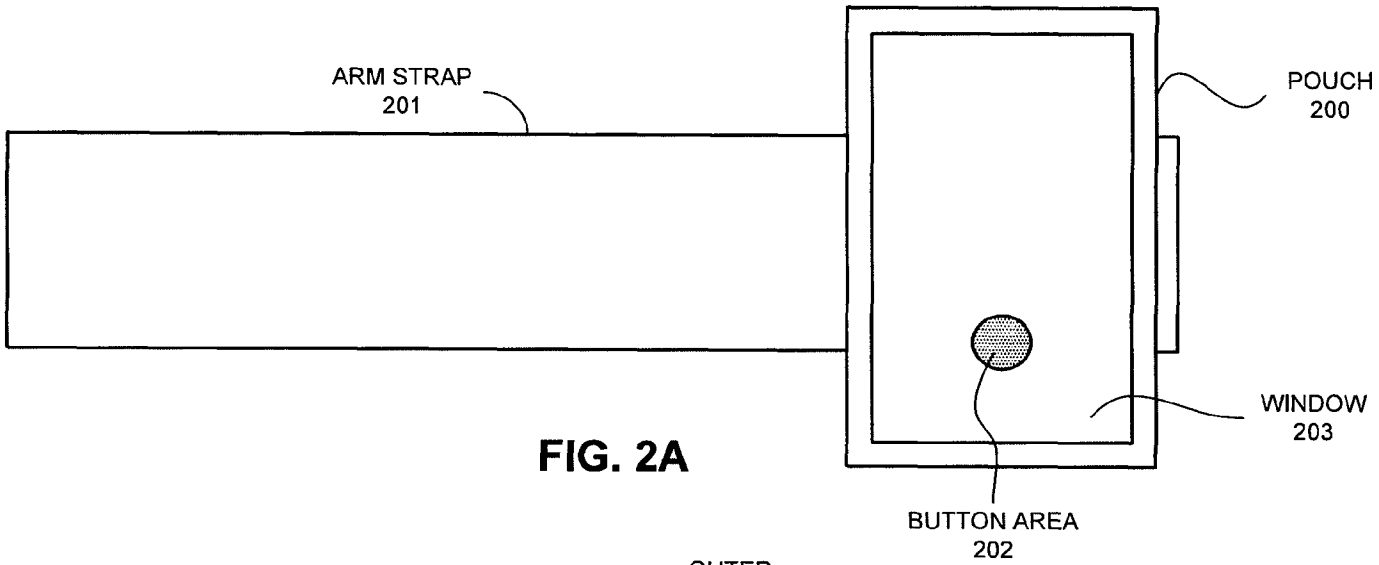
FIG. 2A presents a view of an armband in accordance with an embodiment of the present invention.

FIG. 2A presents a view of an armband in accordance with an embodiment of the present invention. The armband includes pouch 200 and arm strap 201. In some embodiments, pouch 200 has window 203. In some embodiments, window 203 includes button area 202.

Figure 2B:
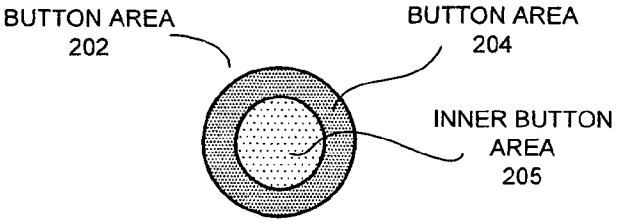
FIG. 2B presents a top view of a button area in accordance with an embodiment of the present invention.

FIG. 2B presents a top view of button area 202 in accordance with an embodiment of the present invention. In some embodiments, a portion of button area 202 protrudes out-of-plane from window 203. In other embodiments, all of button area 202 protrudes out-of-plane from window 203. In other embodiments, button area 202 is co-planar with the surface of window 203.

Although button area 202 is illustrated as a circle, button area 202 can be any shape. For example, button area 202 can be an oval, a square, a rectangle, a diamond, or any other shape. Furthermore, the shape of button area 202 can be chosen based on a specified application (e.g., the shape can substantially match the shape of a button on the electronic device).

Figure 2C:
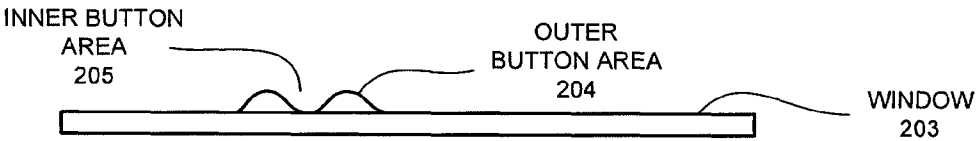
FIG. 2C presents a side view of a button area in accordance with an embodiment of the present invention.

In one embodiment, button area 202 can include inner button area 205 and outer button area 204. In this embodiment, inner button area 205 and outer button area 204 are not co-planar. Instead, outer button area 204 can protrude out of the surface of window 203 more than inner button area 205 protrudes out of the surface of window 203. FIG. 2C presents a side view of button area 202 illustrating this embodiment.

In some embodiments, window 203 includes one or more button areas. For example, window 203 can include a button which is a center button and other buttons which are located around the center button. Note that the center button is not necessarily located at the center of window 203. In some embodiments, one or more detents are located on window 203 to facilitate guiding a finger of a user from the center button to the other buttons. In these embodiments, the one or more button areas can be the same sizes and shapes, can be different sizes and shapes, or can include one or more subsets of button areas with same sizes and/or shapes.

FIG. 3A presents back view of a pouch 300 for an armband which is holding electronic device 302 in accordance with an embodiment of the present invention. (Note that in FIGS. 3A-3B, the arm strap is not shown for the sake of clarity.) As illustrated in FIG. 3A, a hook cell (not shown) is coupled to closure cell 304 so that electronic device 302 is secured within pouch 300. Note that closure cells 304-305 are coupled to pouch 300 whereas the hook cell is coupled to device-securing strap 301.

FIG. 3B presents back view of a pouch 300 for the armband which is holding electronic device with attachment 306 in accordance with an embodiment of the present invention. As illustrated in FIG. 3B, the hook cell (not shown) is coupled to closure cell 305 so that electronic device 302 is secured within pouch 300. Note that a larger electronic device such as electronic device with attachment 306 may protrude from pouch 300. Hence, to accommodate the extra size of electronic device with attachment 306, the hook cell is coupled to closure cell 305 instead of closure cell 304. Also note that there can be any number of closure cells depending on the application.

FIGS. 4A-4C present exemplary views of the coupling of a hook cell with one or more loop cells. FIG. 4A presents a view arm strap 400 for an armband in accordance with an embodiment of the present invention. Arm strap 400 includes hook cell 401 and loop cells 402-405. FIG. 4B presents a view arm strap 400 wherein arm strap 400 is folded over itself so that hook cell 401 is coupled to loop cell 403 in accordance with an embodiment of the present invention. FIG. 4C presents a view arm strap 400 wherein arm strap 400 is folded over itself so that hook cell 401 is coupled to loop cells 404-405 in accordance with an embodiment of the present invention. Note that the cell configurations in FIGS. 4A-4C are used to illustrate the operation of hook cell 401 and loop cells 402-405 and are not meant to limit the scope of the present invention to these cell configurations.

FIGS. 5A-5B illustrate an exemplary process of using an arm strap to secure the armband around an arm in accordance with an embodiment of the present invention. As illustrated in FIGS. 5A-5B, the back side of pouch 500 can be seen. Arm strap 507 and ring 506 are coupled to pouch 500. Furthermore, arm strap 507 includes hook cell 501 and loop cells 502-505. In order to secure the armband around an arm (or another object), the back face of pouch 500 is placed against the arm (not shown). Next, arm strap 507 is pulled round the arm and inserted into ring 506 (see FIG. 5A). Arm strap 507 is then pulled back toward loop cells 502-505 so that hook cell 501 can be coupled to one or more loop cells 502-505. As illustrated in FIG. 5B, hook cell 501 is coupled to loop cells 502-503. Note that hook cell 501 can be coupled to any loop cell depending on the size of the arm that the armband is to be attached.

FIG. 6 presents a view of the armband when arm strap 604 is wrapped around pouch 600 and through ring 603, so that hook cell 601 is coupled to storage-mode cell 602 in accordance with an embodiment of the present invention. In doing so, the armband can be stored so that hook cell 601 will not contact and couple to any other materials (e.g., clothing).

In some embodiments, the shape of an electronic device may cause the front face of the pouch to not lie flush against the top surface of the electronic device when the electronic device is inserted in the pouch. In particular, if the electronic device includes a curved surface (e.g., defined by an elliptical cross-section), the pouch may bow out and away from the top surface of the electronic device when the armband is in use (e.g., and the sides of the pouch are pulled back around a user's arm). In addition, if a stiff window is positioned over one or more apertures of the front face, the difference in stiffness between the window and the material of the pouch (e.g. the difference in stiffness between plastic and felt or synthetic material) may cause the window to bow out.

Figure 7:
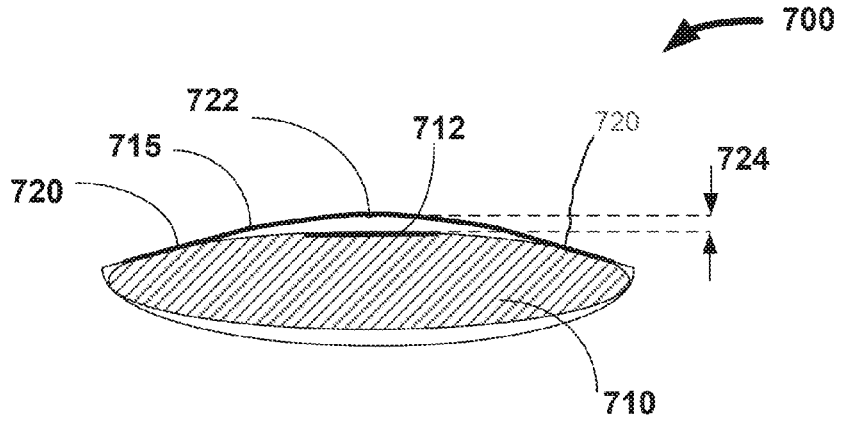
FIG. 7 is a cross-sectional view of a pouch in which an electronic device having a curved surface is inserted in accordance with one embodiment of the invention.

FIG. 7 is a cross-sectional view of a pouch in which an electronic device having a curved surface is inserted in accordance with one embodiment of the invention. Electronic device 710 may be inserted in pouch 700. Electronic device 710 may be of any suitable size or shape. For example, electronic device 710 may include a substantially rectangular shape when viewed from the top (e.g., to fit in substantially rectangular pouch 700). In addition, electronic device 710 may include curved planar surfaces and curved edges such that, when viewed from the bottom, electronic device 710 may resemble an ellipsis or other shape having a curved boundary. For example, electronic device 710 may have an ellipsoid shape. The curved surface of electronic device 710 may cause pouch 700, unless particular care is taken, to lie unevenly on electronic device 710.

The top surface of pouch 700 may include window 715 operative to provide a transparent or translucent surface through which a user may view a display or input mechanism of the electronic device. For example, window 715 may provide a surface through which a user may view input mechanism 712 (e.g., a click-wheel) used to control electronic device operations. Window 715 may extend over any suitable portion of electronic device 710. In some embodiments, when electronic device 710 is contained within pouch 700, window 715 may extend beyond (e.g., substantially beyond) the periphery of input mechanism 712 and may come into contact with any suitable portion of electronic device 710. At particular point 720, window 715 may become tangential to the surface of electronic device 710. Because of the tangential contact and the curvature of the electronic device surface, the portions of the surface of electronic device 710 that are closer to the center of electronic device 710 than point 720 (e.g., portions between the symmetrical points 720) may be prevented from coming into contact with window 715. In particular, if the electronic device surface is symmetrical, the opposing tangential forces on window 715 at symmetrical points 720 (e.g., creating levers around symmetrical points 720) may cause window 715 to bow up and away from the electronic device surface and input mechanism 712 by distance 724. This may increase the desired distance between window 715 and input mechanism 712 and risk adversely affecting the user's ease in providing inputs. In particular, if the distance between the window and input mechanism 712 is such that the user must exert a significant force to bring center point 722 of window 715 in contact with input mechanism 712, the user may not be able to detect a feedback mechanism (e.g., a detectable click) indicating that a button of input mechanism 712 has been pressed.

Figure 8:
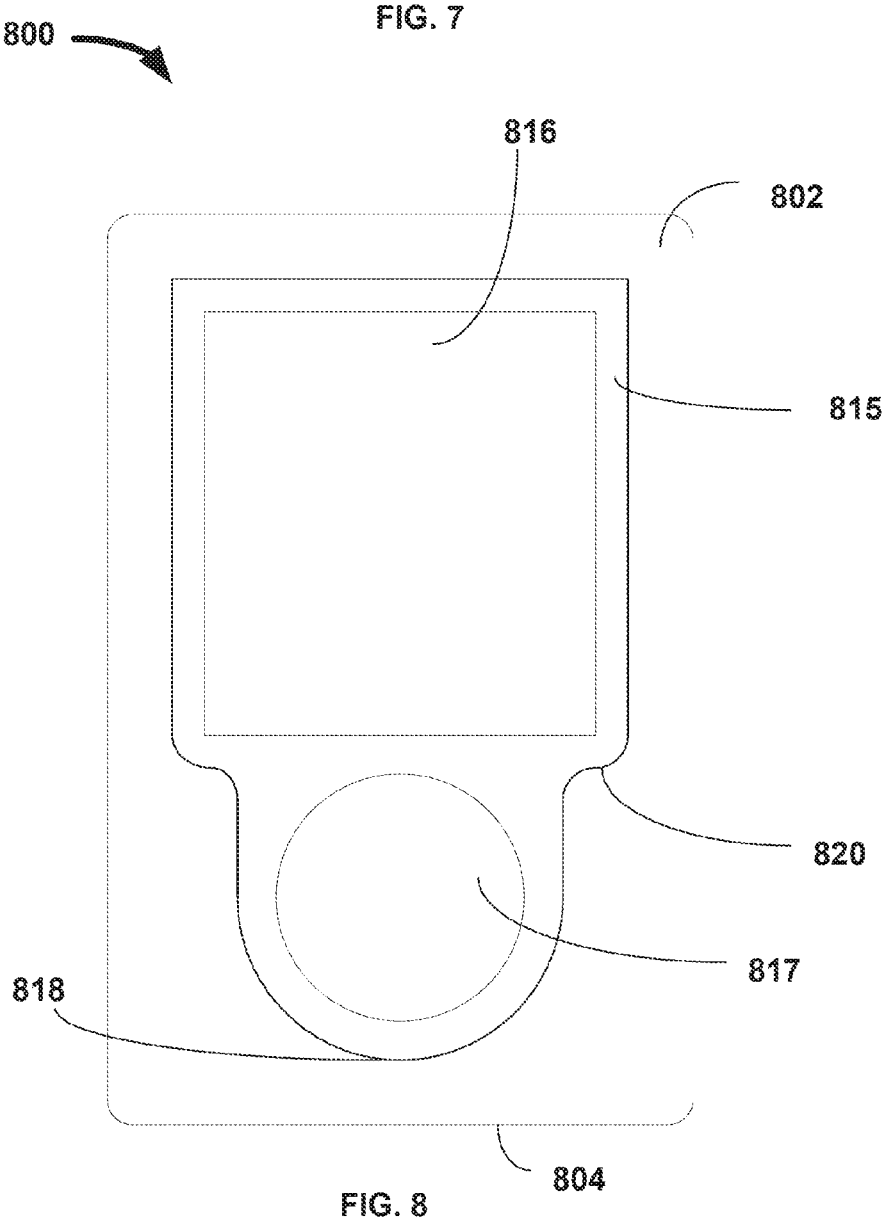
FIG. 8 is a schematic view of the inner surface of the front face of the pouch in accordance with one embodiment of the invention.

Different approaches may be used to ensure that the gap between the window and the input mechanism is sufficiently small (e.g., the window is substantially in contact with the display and with the input mechanism of the electronic device) when the device is inserted in the armband pouch. FIG. 8 is a schematic view of the inner surface of the front face of the pouch in accordance with one embodiment of the invention. Front face 802 of pouch 800 may include aperture 816 through which a display may be visible, and aperture 817 through which an input mechanism (e.g., a click wheel) may be visible. Apertures 816 and 817 may be of any suitable size and shape. For example, aperture 816 may include a rectangular aperture having dimensions in the range of 25 mm to 50 mm by 60 mm to 120 mm, 30 mm to 35 mm by 40 mm to 60 mm, or 33.5 mm by 43.50 mm. As another example, aperture 817 may include a circular aperture having a diameter in the range of 20 mm to 40 mm, 30 mm to 35 mm, or 31 mm. In some embodiments, the width of aperture 816 may be larger than the diameter of aperture 817. In other embodiments, the width of aperture 816 can be about the same as the diameter of aperture 817. In yet another embodiment, the width of aperture 816 can be greater than the diameter of aperture 817.

Front face 802 may include window 815 that is bonded to the inner surface of front face 802 such that window 815 extends beyond the edges of apertures 816 and 817. For example, window 815 may include a first portion that generally conforms to aperture 816 (e.g., a rectangular aperture) and a second portion that generally conforms to aperture 817 (e.g., a circular aperture). If apertures 816 and 817 have different sizes, the width of window 815 may also vary. For example, the width of window 815 may vary in the range of 29 mm to 54 mm to in the range of 24 mm to 44 mm. To ensure that window 815 is properly bonded to front face 802, window 815 may extend by at least a minimum amount beyond the edges of apertures 816 and 817 (e.g., 2 mm). The minimum amount may be determined by the manufacturing process used to bond window 815 to front face 802, which may include for example using an adhesive, tape, pressure, or heat treatment.

To prevent the portion of window 815 within aperture 817 from extending away from an input mechanism of the electronic device (e.g., when the electronic device is contained in the pouch), window 815 may be constructed such that the tangent points causing window 815 to bow out (e.g., discussed above) are brought closer to the centerline of the electronic device. In particular, as the tangent points (e.g., points 720, FIG. 7) move towards each other, for example ending up along or on the centerline of the electronic device, the reduction in distance between the tangent points and the flattening of the curvature of the surface of the electronic device may combine to lead to a reduction in the distance between window 815 and the input mechanism (e.g., reducing distance 724, FIG. 7). The width of window 815 may therefore vary based on the size of the apertures being covered by the window to ensure that the distance between the window and the electronic device under each aperture is minimized. For example, because aperture 816 is larger than aperture 817, the width of window 815 may be larger in the portions adjacent to aperture 816 than in the portions adjacent to aperture 817. In particular, it may be desirable to ensure that the width of window 815 adjacent to aperture 817 (e.g., positioned over the electronic device input mechanism) is smaller than the width of other portions of window 815.

To prevent the differences in window width from being detectable to a user through front face 802, window 815 may include smooth transitions 820 between portions of window 815 having different widths. Window 815 may include any suitable geometry (e.g., smooth edges) between different portions, including for example a spline, curved or faded transitions, or any other suitable smooth edge. By avoiding sharp angles, front face 802 may avoid localized bowing out at or adjacent to transitions 820 between portions of window 815 having different widths.

In some embodiments, tip 818 (of window 815) that is nearest or adjacent to the end of pouch 800 into which an electronic device is inserted (e.g., bottom edge 804) may substantially follow the shape of aperture 817. In particular, tip 818 may not extend far beyond the tip of aperture 817. In the example of FIG. 8, window 815 may follow the edge of circular aperture 817 (e.g., window 815 includes a half circle following the shape of aperture 817 and a click wheel, where tip 818 is a point on the half circle) such that tip 818 remains at a substantial distance from the edge of pouch 800 (e.g., at least 5 mm, 6 mm, 7 mm, or 8 mm). By limiting the distance beyond aperture 817 to which window 815 extends, pouch 800 may be more flexible in areas adjacent to edge 804 (e.g., the edge into which a device is inserted and from which a device is removed), and may allow a user to pull back a portion of pouch 800 or front face 802 to more easily remove the electronic device.

In addition, window 815 and tip 818 may be positioned such that tip 818 defines a single point that is closest to bottom edge 804 (e.g., instead of a straight line substantially parallel to bottom edge 804). Because tip 818 may not include an edge that is substantially parallel to bottom edge 804, when an electronic device is inserted into pouch 800 the area of window 815 that may be caught by the top edge of the device as the device moves past window 815 may be small. This may reduce the risk that a user disengage or weaken the bond between window 815 and front face 802 as the device is inserted or removed. In addition, if tip 818 is located near the centerline of the electronic device, the stiffness of window 815 may naturally cause tip 818 to bow out away from the leading edge of the electronic device, further reducing the risk that the electronic device catches window 815 as it is inserted in pouch 800.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A portable computing device, including:

a device housing that houses an electronic device, the electronic device having a curved display surface and an input area, wherein the input area is configured to receive a touch input; and a first strap having a first end coupled to the device housing, the first strap extending from the device housing and engaging with a second strap for securing the portable computing device to an appendage;

wherein the first strap includes a rear side with a rear side fastening cell and a front side with a front side fastening cell, the front side fastening cell configured to couple to the rear side fastening cell, and wherein the first strap is secured from attachment to other materials by wrapping the first strap around the electronic device and engaging the rear side fastening cell to the front side fastening cell.

2. The portable computing device of claim 1, wherein the first strap includes a plurality of holes.

3. The portable computing device of claim 1, wherein the first strap includes a second end and the second strap includes a first end and second end, and wherein the first strap and second strap are configured such that when the second ends are engaged with each other, the second ends terminate within a perimeter defined by the first strap and the second strap.

4. The portable computing device of claim 1, wherein the device housing includes an aperture through which the display surface of the electronic device is visible to a user of the portable electronic computing device.

5. The portable computing device of claim 1, wherein the first strap is configured to be secured to the device housing and released from the device housing based on an adjustment to the first strap by a user.

6. The portable computing device of claim 1, wherein the second strap includes a first end coupled to the device housing and a second end with a ring portion having an opening, and wherein the first strap passes through the opening in the ring portion of the second strap when the first strap is wrapped around the electronic device.

7. The portable computing device of claim 1, wherein the second strap includes a first end coupled to the device housing and a second end with a ring portion having an opening, and wherein the first strap engages with the second strap by passing through the opening in the ring portion of the second strap for securing the portable computing device to the appendage.

8. The portable computing device of claim 7, wherein the front side of the first strap further includes a loop cell configured to couple to the front side fastening cell such that the portable computing device is secured to the appendage when the first strap passes through the opening in the ring portion and engages the loop cell on the front side of the first strap to the front side fastening cell.

9. A computing system, comprising:

a curved computer body; and an armband including a curved device pouch enveloping the curved computer body, the curved device pouch including an input area configured to receive a touch input from a user and facilitate a display output of the computing system, the armband including a first strap and second strap extending from the armband, wherein the first strap includes a ring portion having an opening, and a distal end of the second strap is configured to concurrently pass through the opening of the ring portion and engage a fastening cell positioned on a middle portion of the second strap; and wherein the curved device pouch includes a first aperture through which the display output of the computing system is visible, and a second aperture through which an input mechanism of the input area is visible and can be engaged by a user of the computer system.

10. The computing system of claim 9, further comprising:

a first closure cell and a second closure cell, each configured to retain the first strap and the second strap secured to the armband respectively.

11. The computing system of claim 9, wherein the distal end of the second strap includes a front side with a front side fastening cell, and the front side fastening cell is configured to engage with the fastening cell positioned on the middle portion of the second strap.

12. The computing system of claim 9, wherein the input area includes a curved perimeter defining an edge of the curved computer body.

13. A computing device, comprising:

a curved device body having opposing edges and configured to support a display surface and an input mechanism, wherein a perimeter of the display surface defines an input area configured to receive a touch input from a user and the input mechanism provides the user with detectable feedback indicating when an input is provided; and a flexible strap portion including a first end positioned at an edge of the curved device body and a second end that includes a first fastening cell, wherein the flexible strap portion wraps around the curved device body and the first fastening cell on the second end of the flexible strap portion engages a second fastening cell positioned on the flexible strap when the flexible strap portion is in a closed configuration.

14. The computing device of claim 13, wherein when the fastening cells are engaged, the second end is positioned at a side of the computing device opposite the display surface.

15. The computing device of claim 13, wherein the input mechanism provides an input to the computing device based on a button of the input mechanism being pressed.

16. The computing device of claim 13, wherein the flexible strap portion is configured to be secured to the curved device body and released from the curved device body based on an adjustment to the flexible strap portion by the user.

17. The computing device of claim 13, wherein the second end of the flexible strap portion is configured to penetrate a ring portion in the closed configuration, the ring portion positioned at the edge of the curved device body opposing the edge at which the first end of the flexible strap is positioned.

* * * * *